United States Patent [19]

Nakano et al.

[11] 4,266,521

[45] May 12, 1981

[54] METHOD OF FUEL INJECTION CONTROL DURING STARTING

[75] Inventors: Jiro Nakano; Hideo Miyagi, both of Okazaki, Japan

[73] Assignee: Toyota Jidosha Kogyo Kabushiki Kaisha, Aichi, Japan

[21] Appl. No.: 31,478

[22] Filed: Apr. 19, 1979

[30] Foreign Application Priority Data

Oct. 6, 1978 [JP] Japan ..... 53-122513

[51] Int. Cl.[3] ..... F02B 3/00

[52] U.S. Cl. ..... 123/491; 123/179 L

[58] Field of Search ..... 123/32 EG, 32 EA, 179 L

[56] References Cited

U.S. PATENT DOCUMENTS

| | | | |
|---|---|---|---|
| 4,148,283 | 4/1979 | Harada et al. | 123/32 EG |
| 4,171,692 | 10/1979 | Drews et al. | 123/32 EG X |
| 4,184,460 | 1/1980 | Harada et al. | 123/32 EG |
| 4,227,491 | 10/1980 | Schnurte et al. | 123/179 L X |

*Primary Examiner*—Tony M. Argenbright

*Attorney, Agent, or Firm*—Stevens, Davis, Miller & Mosher

[57] ABSTRACT

In conventional electronic fuel injection systems, the flow rate of a fuel supply is fixed during a starting operation irrespective of time variations in the running parameters of an internal combustion engine. In accordance with the disclosed method and apparatus of the invention, however, the fuel supply flow rate is controlled in accordance with the time variations in the engine running parameters in the same manner as occurs after the starting operation, that is, during normal engine running operations, when at least one of the engine operating conditions of r.p.m. being higher than a preset level and flow rate of intake air being higher than a preset level is satisfied. Thus, the engine running operations either at a higher engine r.p.m. or at a higher intake air flow rate during the engine starting period can be stabilized while improving the engine startability and smoothing the engine running operations when an ignition switch is returned from its starting to its "on" position.

5 Claims, 7 Drawing Figures

METHOD OF FUEL INJECTION CONTROL DURING STARTING

BACKGROUND OF THE INVENTION

1. Field of the Invention

The present invention relates to a fuel supply control method and apparatus for an internal combustion engine, and more particularly, to an electronic control fuel injection method and apparatus for operating a fuel injector in the air intake system of the engine in response to electric signals thereby to control the flow rate of fuel supply, especially during the engine starting operation.

2. Description of the Prior Art

In a conventional electronic control fuel injection method, during the normal running condition of an internal combustion engine, i.e., when the ignition switch of a driver's compartment is left in its "on" position, the flow rate of fuel supplied to the engine is controlled in relation to time variations in the running parameters of the engine. However, during a starting operation of the engine, when the ignition switch is held in its "starting" position, the flow rate of fuel supply is fixed irrespective of time variations in the engine running parameters. This fixed flow rate of fuel supply during the starting operation may be suitable when the engine is run at a very low r.p.m. or when the flow rate of intake air is at a very low level. However, if the ignition switch remains held in the "starting" position even after engine r.p.m. or the flow rate of intake air is increased, the difference between such fixed fuel flow rate and the flow rate actually demanded by the engine becomes so large as to result in a substantial deterioration in the ability of the engine to start.

SUMMARY OF THE INVENTION

Accordingly, a major object of the present invention is to provide an improved electronic control fuel injection method and apparatus which can improve the startability of an internal combustion engine without resorting to a complex circuit construction or to a complex programming of the circuit.

To attain the above object, the present invention provides an improved electronic control fuel injection method and apparatus in which the fuel supply flow rate is controlled when engine r.p.m. and/or intake air flow rate are higher than preset levels $N_0$ and $Q_0$, respectively, even during the engine starting period. Thus, fuel supply control is effected, during starting, in a similar manner to the fuel supply control effected under a normal engine running condition, i.e., that after an ignition key is returned from its "starting" to "on" position. In other words, the invention controls the fuel supply flow rate during engine starting in relation to the time variations in the running parameters of the engine. However, the invention also includes supplying a fixed fuel supply flow rate irrespective of the time variations of the engine running parameters if the noted predetermined conditions do not exist during the engine starting period.

BRIEF DESCRIPTION OF THE DRAWINGS

Other objects and advantages of the present invention will become apparent from the following description taken in conjunction with the accompanying drawings, in which.

DESCRIPTION OF THE PREFERRED EMBODIMENTS

Figure 1:
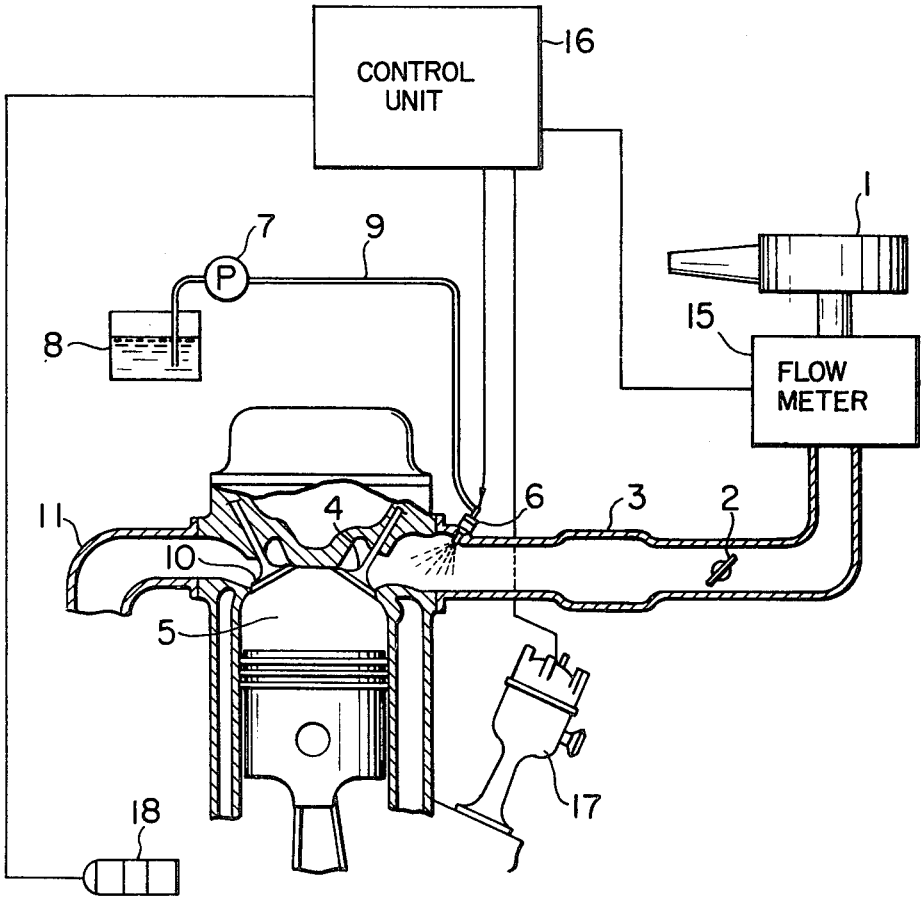
FIG. 1 is an explanatory view showing the overall construction of a system exemplifying the electronic control fuel injection method according to the present invention.

The embodiments of the present invention will be described with reference to the accompanying drawings. Referring first to FIG. 1, intake air sucked through an air cleaner 1 is supplied to a combustion chamber 5 via a surge tank 3 and an intake valve 4. The flow rate of the intake air is controlled by means of a throttle valve 2 which moves in association with an accelerator pedal in a driver's compartment. A fuel injector 6 is mounted in an air intake system in the vicinity of the intake valve 4 and has its opening controlled in response to electric input pulse signals to thereby inject fuel under pressure towards the combustion chamber 5. A fuel pump 7 pressurizes the fuel in a fuel tank 8 and supplies the pressurized fuel to the fuel injector 6 via a conduit 9. After combustion, the resultant exhaust gases are discharged to the atmosphere via an exhaust valve 10 and an exhaust manifold.

Interposed between the air cleaner 1 and the throttle valve 2 is an air flow meter 15 which detects the flow rate of intake air, feeding output signals representative of such flow to an electronic control unit 16. An ignition distributor 17 is equipped with a rotational-angle sensor which feeds signals indicative of engine r.p.m. to the electronic control unit 16. In order to determine whether the engine is being started or not, a voltage signal is provided to the electronic control unit 16 representing whether or not a starter (or a starter motor) 18 is being operated.

Figure 2:
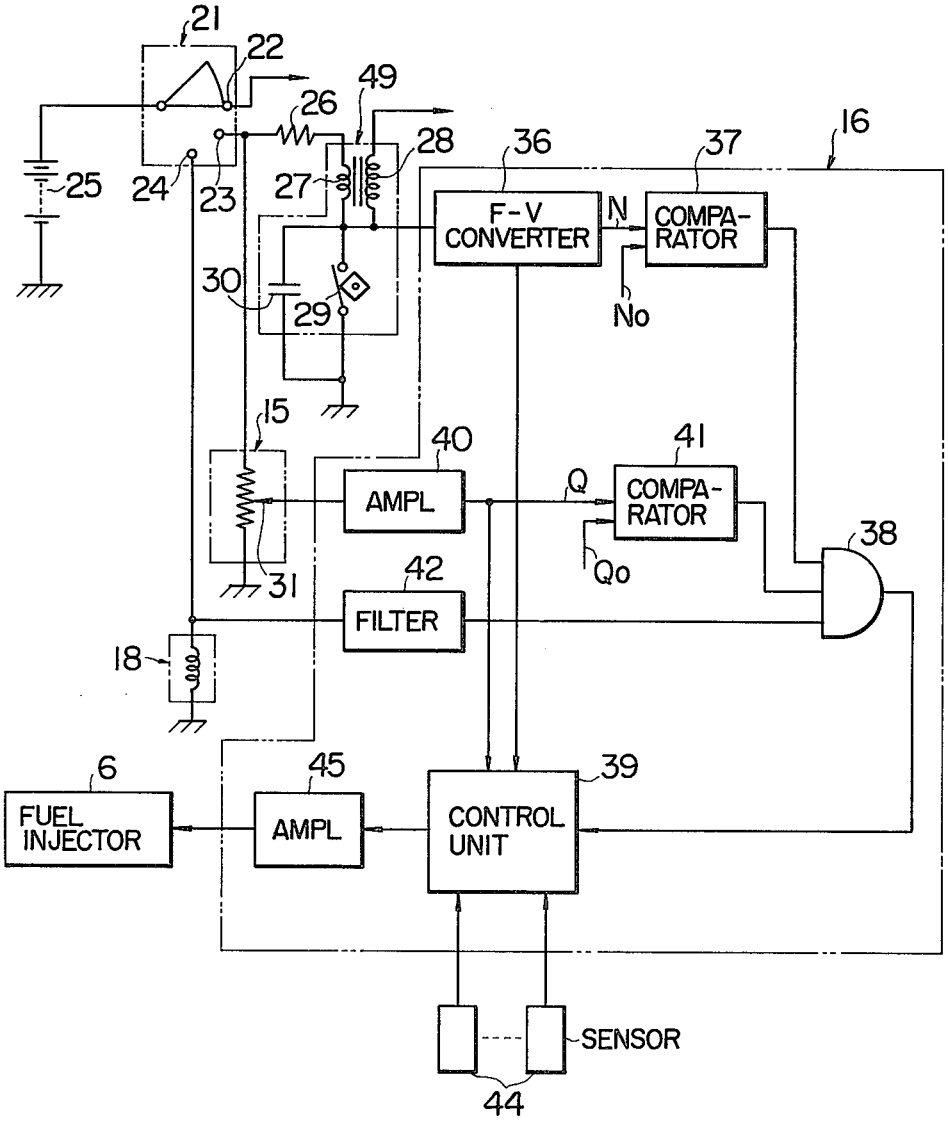
FIG. 2 shows, in block diagram format, an electronic control unit used with the electronic control fuel injection system of FIG. 1.

FIG. 2 shows a typical embodiment of the electronic control unit 16. In this embodiment, an ignition switch 21 is equipped with an accessory terminal 22, an "on" terminal 23 and a starting terminal 24 and is adapted to be manually operated to selectively control the connection of terminals 22, 23 and 24 with a DC power source 25. The "on" terminal 23 is connected via a resistor 26 with an ignition system 49 and the air flow meter 15. The ignition system 49 is equipped with a primary coil 27 which is connected with the resistor 26, a secondary coil 28 which is connected with the ignition plugs of the respective combustion chambers 5 via the (not-shown) ignition distributor, a breaker 29 which is connected in series with the primary coil 27, and a condenser 30 which is connected in parallel with the breaker 29 to prevent any spark from building up between the points of the breaker 29.

The air flow meter 15 is constructed as a potentiometer and is equipped with a movable terminal 31 which can shift its position in accordance with the rotations of a (not-shown) metering disc. The starting terminal 24 is connected with the starter 18 and functions as a detecting terminal for supplying the noted voltage signal upon the engine starting operation.

The connecting point between the primary coil 27 and the breaker 29 is connected with a F-V (i.e., frequency-voltage) converter 36 of the electronic control unit 16. The F-V converter 36 generates a voltage indicative of the r.p.m. N of the engine and its output is fed via a comparator 37 to an "and" circuit 38 and further to an operation control unit 39. The movable contact 31 of the air flowmeter 15 is connected with a voltage amplifier 40. Amplifier 40 generates a voltage indicative of the flow rate Q of intake air and its output is fed to the operation control unit 39 and to the "and" circuit 38 via a comparator 41. The starting terminal is connected through a noise filter 42 with the "and" circuit 38. The reference terminals of the comparators 37 and 41 are supplied with the voltages which correspond to preset levels $N_0$ $Q_0$, respectively. Preset levels $N_0$ and $Q_0$ represent respectively, a proper engine r.p.m. and intake air flow rate, which are deduced in advance by experiments. The output of "and" circuit 38 is fed to the operation control unit 39, the latter of which also receives the output of sensor 44 which detect other running parameters of the engine e.g., the temperature of cooling water, or the intake vacuum, etc. The output of the operation control unit 39 is fed to the fuel injector 6 via a current amplifier 45. The fuel injector 6 may be of an electromagnetic valve type so that it opens its passage during its operating period when supplied with a preset current so as to continue its fuel injection.

The operations of the electronic control unit 16 thus constructed will now be described. For purposes of the following, description signals at a higher voltage level are defined to be at a "1" level, while the signals at a lower voltage are defined to be a "0" level. Since the connection between the DC power source 25 and the starting terminal 24 is interrupted during the normal running operation of the engine, i.e., when the starter 18 is inoperative, the signals fed to the "and" circuit 38 from starting terminal 27 are at a "0" level so that the output of the "and" circuit 38 is held at the "0" level. As a result, signals representing engine running parameters are fed from the F-V converter 36 (r.p.m.), and the voltage amplifier 40 and the sensor 15 (intake air) directly to the operation control unit 39. The operation control unit 39 calculates from the received engine running parameters the opening period of the fuel injector 6 and provides fuel injector energizing signals which are fed to the fuel injector 6 via the current amplifier 45. With this arrangement, the flow rate of fuel supplied to the engine can be controlled in accordance with the running parameters of the engine at any particular time.

On the other hand, when starter 18 is energized, the "on" terminal 23 and the starting terminal 24 are simultaneously connected with the DC power source 25, and terminal 24 is held at the "1" level. As a result, the signals fed to the "and" circuit 38 are also at the "1" level. If, under this condition, the engine r.p.m. is lower than the preset level $N_0$ and the intake air flow rate is lower than the preset level $Q_0$, then the outputs of the comparators 37 and 41 are both at the "1" level so that the output of the "and" circuit 38 is maintained at the "1" level. Under this condition, the operation control unit 39 senses the "1" output of gate 38 and produces a fixed output signal irrespective of the time changes in the engine running parameters. In other words, as long as engine r.p.m. and the intake air flow rate are both below their respective preset levels the flow rate of fuel supplied through the fuel injector 6 is kept at a fixed level.

It should be noted that the so-called fixed level of fuel supply flow rate set by the operation control unit 39 when both belt engine r.p.m. and intake air flow are below their respective preset levels, may also be controlled, if desired, so as to change in accordance with other engine running parameters at the beginning of starter 18 operation. For example, the level of fuel supply flow rate may vary with the temperature of cooling water. Thus, the term "fixed" refers to the fuel supply rate set by the operation control unit 39 when engine r.p.m. and intake air are both below their respective levels but does not mean that the fuel supply level is fixed irrespective of other engine running parameters at the beginning of starter 18 operation.

Once, during engine starting, at least one of the engine r.p.m. and the intake air flow rate reach their respective preset levels $N_0$ and $Q_0$ input signals having a "0" level are fed to the "and" circuit 38 via the comparator 37 or 41 causing the output of the "and" circuit 38 to change to a "0" level irrespective of the fact that starter 18 is being operated. The operation control unit 39 senses this "0" level and carries out the same operations as it would under normal engine running conditions, i.e., when the ignition switch 21 is in its "on" position. The engine r.p.m. and the intake air flow rate will be increased not in a uniform manner but in a pulsating manner during the operating period of the starter 18, i.e., while the ignition switch 21 is retained in its starting position. If, however, both the engine r.p.m. and the intake air flow rate become lower than their preset levels $N_0$ and $Q_0$, after at least one of them reaches the preset level $N_0$ or $Q_0$, the above-mentioned fixed fuel supply is restored so long as the starter 18 is being operated.

Figure 3A:
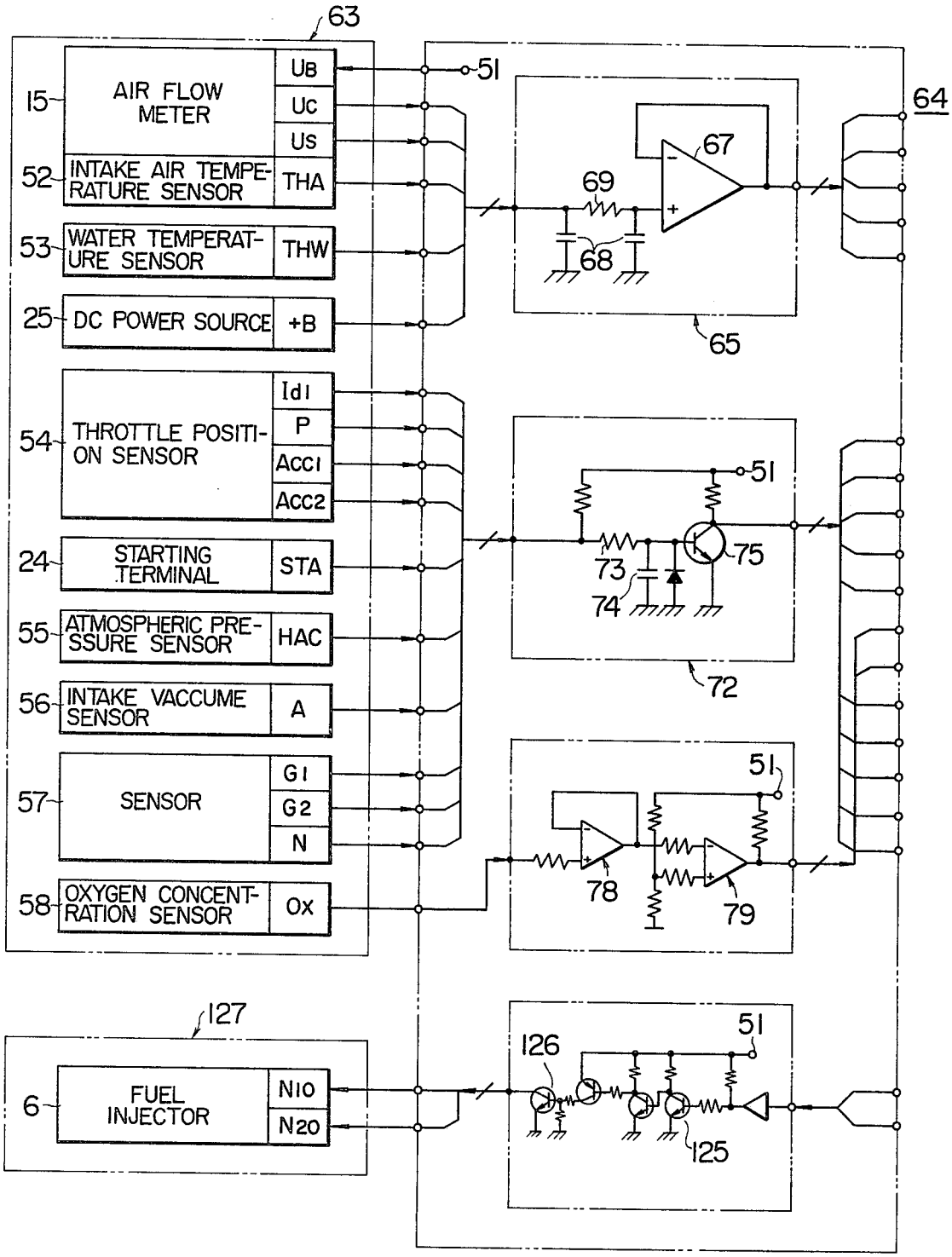
FIG. 3*a*, 3*b* and 3*c* taken together show in block diagram format a microprocessor circuit used as the electronic control unit shown in FIGS. 1 and 2.
Figure 3B:
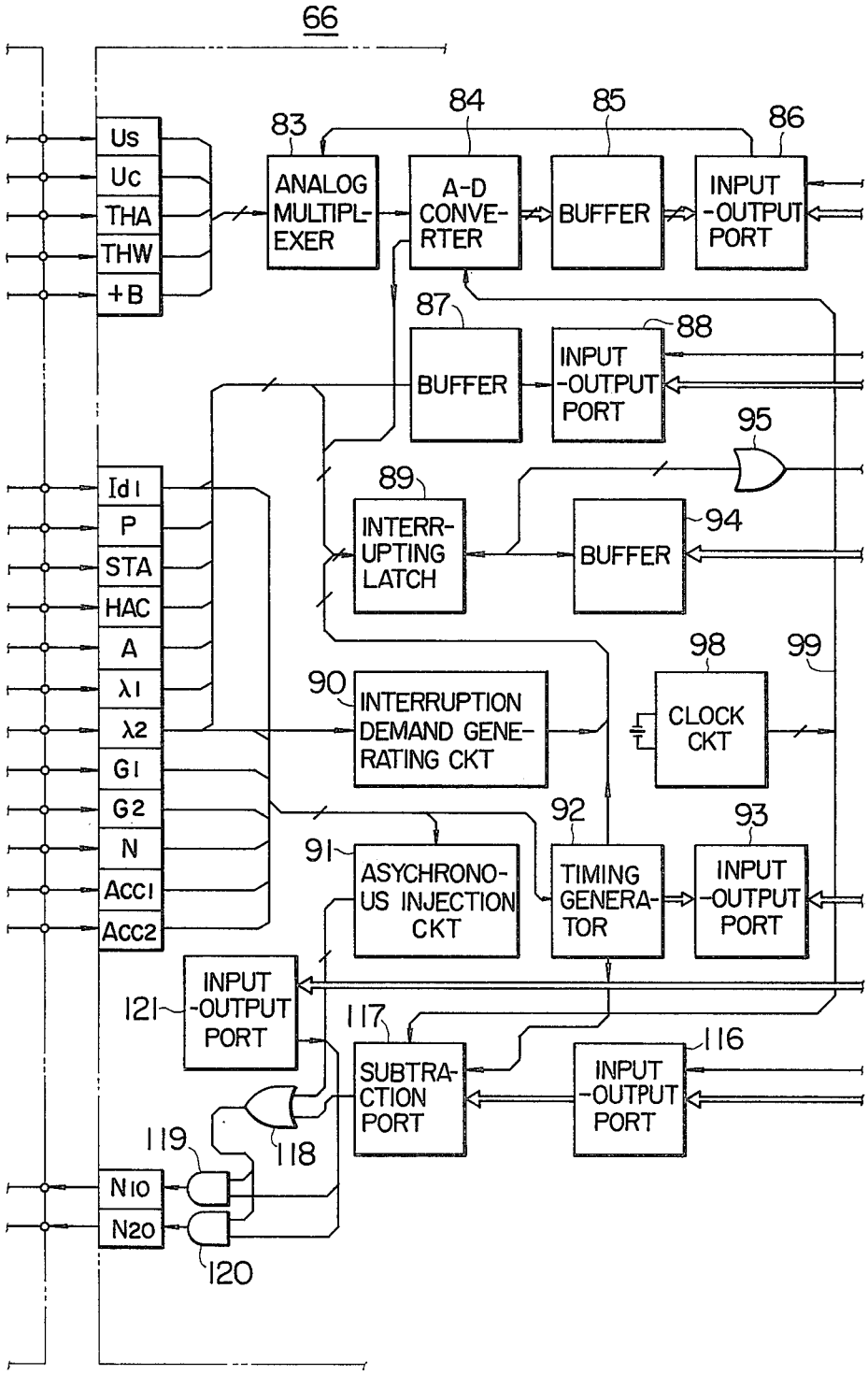
Figure 3C:
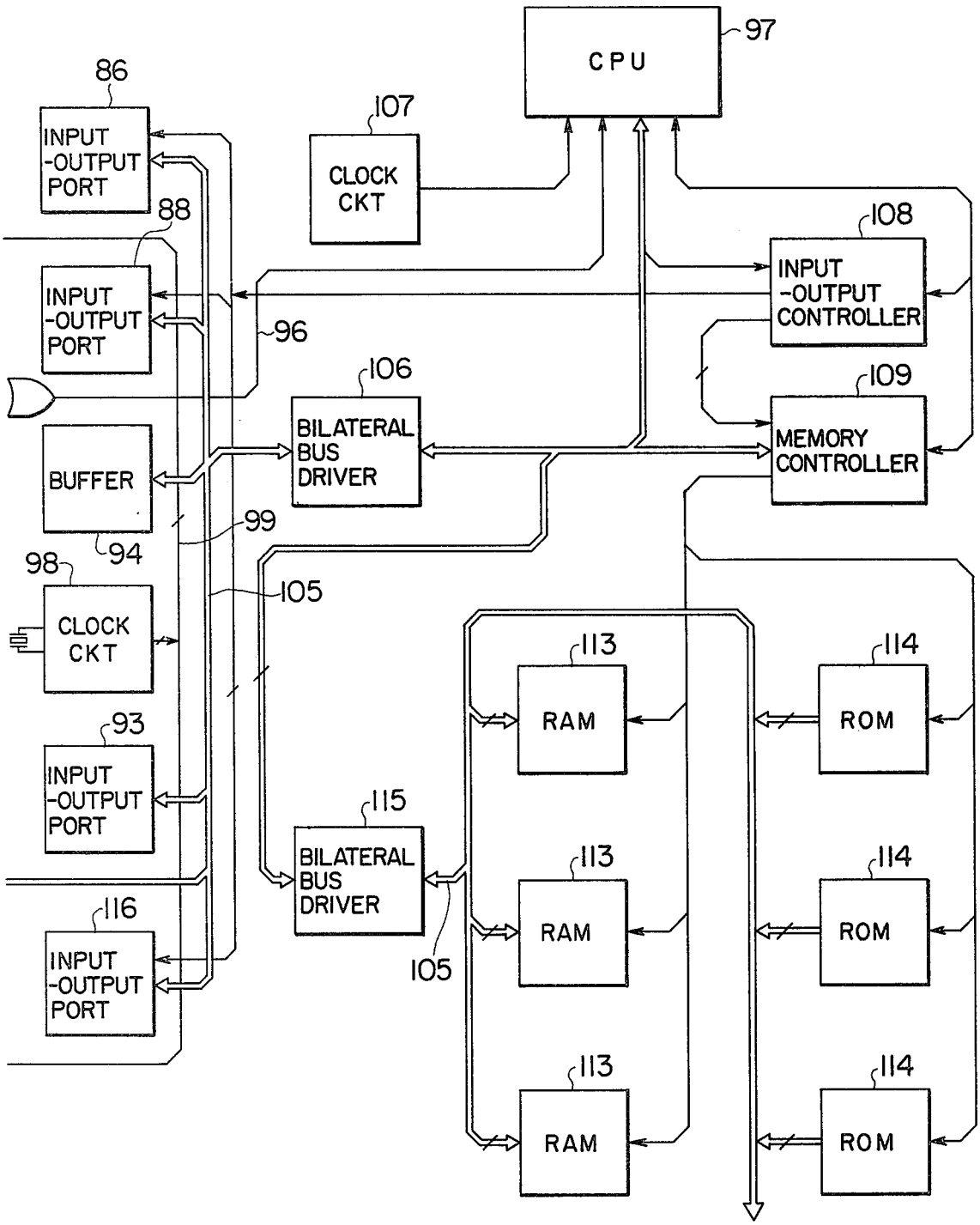

FIGS. 3*a* to 3*c* show one example of a suitable electronic control unit 16 which uses a microprocessor. Plural like signal lines are indicated with slash symbols for simplicity only. The air flow meter 15 is equipped with a $U_B$ terminal which is connected with a power source 51 of 5 volts, a $U_C$ terminal which is connected with a fixed intermediate point of the potentiometer, and a $U_S$ terminal which is connected with the movable contact 31 of the potentiometer. The reason for provision of the $U_C$ terminal is to compensate the voltage fluctuations at the $U_S$ terminal due to those at the power source 51. An intake air temperature sensor 52 having a terminal THA is attached to the metering disc of the air flow meter 15 to detect the temperature, i.e., density, of the intake air. Generally, the flow rate of fuel supply will be increased in accordance with the increase in the density of the intake air. A water temperature sensor 53 having a terminal THW is attached to the water jacket of the engine to detect the temperature of the cooling water within the jacket. During the engine warm-up, the flow rate of fuel supplied to the engine is inversely proportioned to the temperature of the cooling water; thus the flow rate of fuel supply increases with lowering cooling water temperature. A "+B" terminal is connected with a battery, i.e., the DC power source 25. Since the ineffective injection period of the fuel injector increases as the voltage of the DC power source 25 lowers, the width of the pulses fed to the fuel injector 6 from the electronic control unit 16 increases accordingly. A throttle position sensor 54 is provided and equipped with four terminals $Id_1$, P, $Acc_1$ and $Acc_2$. The first terminal $Id_1$ is used to detect the fully closed (i.e., idling) position of the throttle valve 2. The second terminal P is used to detect a preset larger opening (e.g., an opening of 60 degrees with respect to the fully closed opening) so as to increase the flow rate of fuel supply thereby to increase the output of the engine. The third and fourth terminals $Acc_1$ and $Acc_2$ are used to detect the varying rate of the opening of the throttle valve 2. An STA terminal is connected with the starting terminal 24 while an HAC terminal is connected with an atmospheric pressure sensor 55 which is made operative to detect the atmospheric pressure indicative of altitude. Since the density of the intake air is reduced when a car is operated at high altitudes, the fuel supply flow rate is accordingly decreased. An A terminal is connected with an intake vacuum sensor 56 which detects the intake vacuum which is related to the engine load. A sensor 57, built into the ignition distributor 17, is equipped with three terminals $G_1$, $G_2$ and N. The signals appearing at the terminal N correspond to the signals which are fed from the ignition distributor 17, as shown in FIG. 1. As will be described later, the combustion chambers 5 of the engine are classified into two groups N10 and N20 in connection with their firing orders. More specifically, for every two revolutions of the crank shaft of the engine, the fuel is supplied during the earlier revolution simultaneously to the combustion chambers belonging to the group N10 and during the later revolution simultaneously to the combustion chambers belonging to the group N20. The terminals $G_1$ and $G_2$ are used to judge whether the fuel should be supplied to the combustion chambers belonging to the group N10 or N20. On the other hand, the terminal N is used to detect the r.p.m. of the engine while generating a predetermined number, e.g., six, pulses for one revolution of the crank shaft. An $O_X$ terminal is connected with an oxygen concentration sensor 58, which is mounted in the exhaust system of the engine so as to detect the oxygen concentration in the engine exhaust gases, i.e., the richness or leanness of the combustible mixture, being supplied to the combustion chambers.

As shown in FIGS. 3*a* through 3*c*, the sensor unit 63 has its terminals $U_C$, $U_S$, THA, THW and +B connected with the corresponding input terminal $U_C$ or +B of an operational unit 66 by way of buffers 65 (only one of which is shown) which are provided in a power unit 64 in accordance with the number of input signals. Each of the buffers 65 is of such a known type and includes an operational amplifier 67 for amplifying the analog input voltage and a low-pass filter consisting of a capacitor 68 and a resistor 69 connected to the input of the operational amplifier 67. The terminals $Id_1$, P, N of the sensor unit 63 are connected with the corresponding input terminals $Id_1$, P, N of the operational unit 66 by way of buffers 72 of the power unit 64, respectively.

Each of the buffers 72 is of a known type and include a low-pass filter consisting of a resistor 73 and a capacitor 74 and a switching transistor 75. The sensor 57 built into the distributor is of the electromagnetic pickup type with the voltages at terminals $G_1$, $G_2$ and N varying in relation to the r.p.m. of the engine. The $O_X$ terminal, which is connected with the oxygen concentration sensor 58 in the exhaust system, is connected with terminals $\lambda_1$ and $\lambda_2$ of the operational unit 66 by way of a buffer 78 and a comparator 79 of the power unit 64, respectively. The buffer 78 is equipped with an operational amplifier for matching the impedance of the output of the oxygen concentration sensor 58 while the comparator 79 is made operative to compare its input voltage with a preset voltage so as to generate pulses in accordance with the richness or leanness of the combustible mixture. The terminal $\lambda_1$ of the operational unit 66 is used to judge whether the oxygen concentration sensor 58 reaches its activated range and is disconnected or not. More specifically, the output of the oxygen concentration sensor 58 is changed to a "1" or "0" level in relation to the air-fuel ratio of the mixture when the sensor 58 is operated under its normal condition. When, on the contrary, the oxygen concentration sensor 58 is either in its inactivated range, in which the temperature fails to reach a preset level, or under its disconnected condition, its output is maintained at the "1" level while failing to change to the "0" level. The fact that the input voltage at the terminal $\lambda_1$ reaches the "0" level implies that the oxygen concentration sensor 58 is operating under its normal condition.

The input voltage at the terminal $U_S$ or +B of the operational unit 66 is multiplexed by an analog multiplexer 83 and then fed to an A-D (analog-digital) converter 84. The output of the A-D converter 84 is fed, via a buffer 85, to an input-output port 86, where it is maintained. The input signals at the input terminals $Id_1$, P, STA, HAC, A, $\lambda_1$ and $\lambda_2$ of the operational unit 66 are fed partly to an input-output port 88 via a buffer 87 and partly to an interrupting latch 89. Since, with respect to the oxygen concentration sensor 58, the interrupting signals are required when their level is changed from "1" or "0" and vice versa, the input voltage at the terminal $\lambda_2$ is fed to the interrupting latch 89 via an interruption demand generating circuit 90. The input signals at the terminals $\lambda_2$, $G_1$, $G_2$, $N_1$, $Acc_1$ and $Acc_2$ of the operational unit 66 are fed to both an asychronous injection circuit 91 and a timing generator 92. Since there is established in a response delay in the output of a later-described CPU (central processing unit) 97 during a transient operation of the engine such as acceleration, the output of the asynchronous injection circuit 91 is fed to the fuel injector 6. The width of the output pulses of the asynchronous injection circuit 91 is determined by the CPU 97, e.g., in relation to the temperature of cooling water. The timing generator 92 operates to judge the groups of the fuel injectors 6 to be operated so that a trigger may be produced at a preset crank angle before T.D.C. (top dead center) of the engine. The output of the timing generator 92 is fed to not only the interrupting latch 89 but also an input-output port 93. The eight outputs of the interrupting latch 89 are fed to a buffer 94 and to an "or" circuit 95 which is equipped with eight terminals. The outputs of this "or" circuit 95 are fed to the CPU 97 via one interrupt demand line 96. The CPU 97 detects both the existence of an interrupt signal via the interrupt demand line 96 and the type of interrupt via the buffer 94. A clock circuit 98 generates clock pulses as synchronous signals so that the clock pulses thus generated may be fed to the respective elements. The output terminals of the input-output terminals are connected with a bus 105. A bilateral bus driver 106 is provided midway of the bus 105. A clock circuit 107 feeds clock pulses to the CPU 97, by which an input-output controller 108 and a memory controller 109 are controlled. The input-output controller 108 is responsive to the commands from the CPU 97 to control the data feed timing of the input-output port 86 or the like. On the other hand, the memory controller 109 is operative to control the data input and output of an RAM (random access memory) 113 and an ROM (read-only memory) 114, in which the programs and the fixed data for the CPU 97 are stored. The CPU 97, the RAM 113 and the ROM 114 are connected via the bus 105, between which a bilateral bus driver 115 is provided. The data from the input-output ports 86, 88, 93 and 94 are once stored in the RAM 113 and then processed by the CPU 97. The output of the CPU 97, i.e., the digital value corresponding to the open period of the fuel injector 6, is fed to and held in an input-output port 116 so that it may be fed at a preset time to a subtraction counter 117. This subtraction counter 117 is made operative to change its output from the "0" to "1" level in response to the trigger from the timing generator 92 so that it may subtract its counted value by one every time it receives one clock pulse so as to maintain its output at the "1" level until its counted value is reduced to zero. In this way, the pulses having such a width as relates to the digital value from the output 116 are fed to the terminals N10 and N20 via an "or" circuit 118 and "and" circuits 119 and 120. An input-output port 121 is operative to feed the "0" signals to the "and" circuits 119 and 120, during deceleration, e.g., in case a cut in the fuel supply is required, so that the fuel injector 6 may be forced into its closed condition. In the remaining cases, however, the input-output port 121 feeds the "1" signals to the "and" circuits 119 and 120. The output terminals N10 and N20 are connected with the terminals N10 and N20 of an actuator unit 127, respectively, by way of a conventional buffer 125 and a power stage 126.

In the embodiment thus far described, the engine consists of six cylinders classified in accordance with their firing orders into two groups, i.e., the group N10, to which the odd cylinders belong, and the group N20, to which the even cylinders belong. Thus, the terminal N10 is connected with the fuel injectors 6 of the group N10 while the terminal N20 is connected with the fuel injectors 6 of the group N20.

Exemplary of the commercially available products which can be used in the FIGS. 3*a* through 3*c* circuit are the following:

| Name of Element | Part Number | Maker |
|---|---|---|
| Buffer 85 | MM80C96 | N.S. |
| Input-Output Port 86 88, 93 and 116 | T3220 | T.S.E. |
| Buffer 87 | TC5012 | " |
| Interrupting Latch 89 | T3219 | " |
| Buffer 94 and Bilateral Bus Driver 106 and 115 | T3269 | " |
| CPU 97 | TLCS-12A | " |
| Input-output Controller 89 | T3418 | " |
| Memory Controller 109 | T3461 | " |
| RAM 113 | μPD5101CE | N.E.C. |
| ROM 114 | TMM121C-1 | T.S.E. |

In the above Table, letters "N.S." designate "National Semiconductor;" letters "T.S.E." designate "Tokyo Shibaura Electric Co., Ltd." of Japan; and letters "N.E.C." designate "Nippon Electric Co., Ltd." of Japan.

Turning now to the flow chart of FIG. 4, one example of the program stored in ROMs 114 and carried out in CPU 97 will be explained. At step 130, the CPU determines whether or not starter 18 is being operated. If the answer is "NO," the program proceeds to step 131 where the fuel supply for normal engine running condition is determined in accordance with the time variations in the running parameters of the engine. In this instance, the open period $\tau$ of the fuel injector 6 can be calculated in accordance with the following equation:

$$\tau = K \cdot (Q/N) \cdot \gamma,$$

wherein K indicates a constant; Q indicates the flow rate of intake air; N indicates the r.p.m. of the engine; and, $\gamma$ indicates a correction coefficient relating to the levels of the remaining running parameters.

If the answer at the step 130 is "YES" indicating that starter 18 is operating, the program proceeds to step 132. At step 132, the engine r.p.m. N is read and the determination of whether or not $N \geqq N_O$ holds is performed at step 133. If the answer at step 133 is "YES," the program proceeds to the step 131 where the fuel supply for normal engine running is determined, while if the answer is "NO," the program proceeds to step 134. At step 134, the intake air flow rate Q is read and a determination of whether or not $Q \geqq Q_O$ holds is performed at step 135. If the answer in step 135 is "YES," the program proceeds to step 131, while if the answer is "NO", the program proceeds to step 136. At step 136, the fuel supply is set such that the open period $\tau$ of the fuel injector 6 is fixed irrespective of the time variations in the running parameters of the engine. It will be understood from the program of FIG. 4 that the fuel supply flow rate is changed from a fixed value to a value which varies according to the engine running parameters if at least one of the conditions that engine r.p.m. $N \geqq N_0$ and the intake air flow rate of $Q \geqq Q_0$ *is satisfied.*

Figure 4:
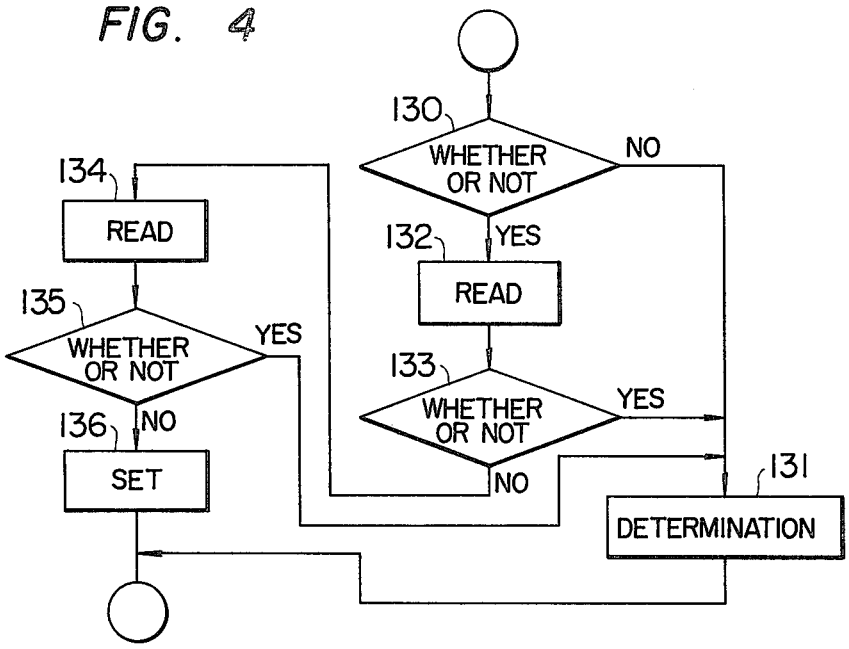
FIGS. 4 and 5 are flow charts showing two examples of programs executed by the microprocessor shown in FIGS. 3*a* to 3*c*.
Figure 5:
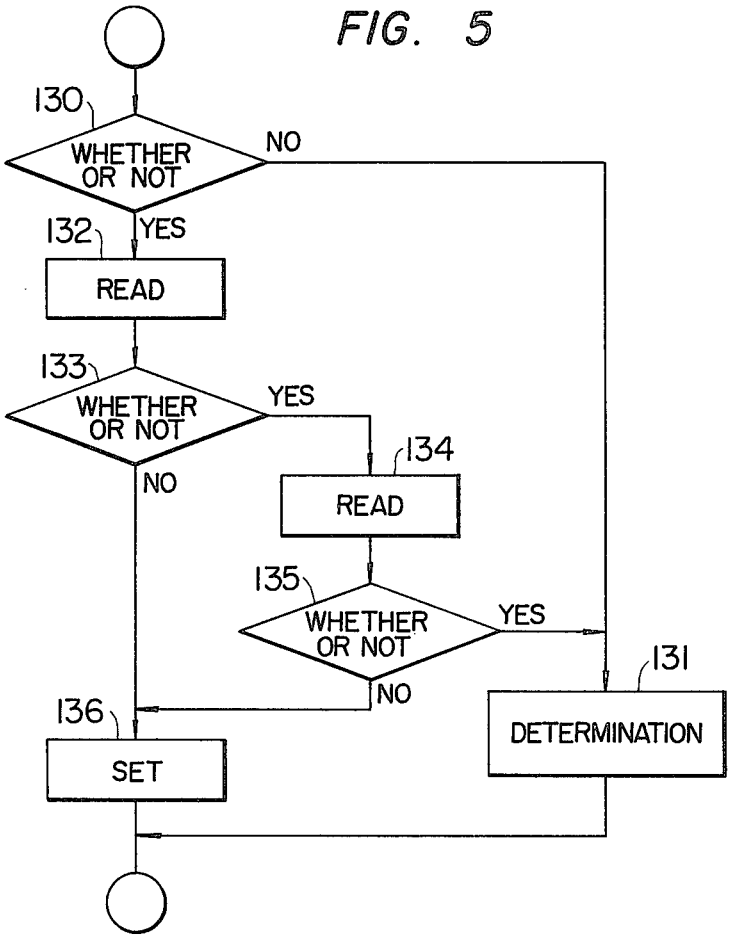

FIG. 5 is a flow chart showing another example of the program, in which the steps corresponding to those of FIG. 4 are indicated by the same reference numerals. In the program of FIG. 5, if the answer at the step 133 is "YES" indicating that engine r.p.m. N equals or exceeds the predetermined value $N_0$, the program proceeds from step 133 to step 134. If a "NO" answer prevails in step 133, the program instantly proceeds from step 133 to step 136. Moreover, if the answer at the step 135 is "YES" indicating that intake air flow rate Q is equal to or greater than the predetermined value $Q_0$, the program proceeds to step 131, while in the case of a "NO" answer, the program proceeds to step 136. With the program of FIG. 5, if the ignition switch 18 is in its starting position, the fuel supply is also changed from a fixed fuel supply rate to one varying in accordance with engine running parameters if both the engine r.p.m. N is higher than the level $N_0$ and the intake air flow rate Q is higher than the present level $Q_0$.

According to the present invention, if at least one of the two engine operating conditions of the engine r.p.m. N being higher than the present level $N_0$ and the intake air flow rate Q being higher than the present level $Q_0$ is satisfied even during the operation of the starter 18, i.e., even while the ignition switch is in its starting position, the flow rate of fuel supply is controlled according to the time variations in the engine running parameters so that the engine startability can be improved to a remarkable extent. Since, moreover, the normal fuel supply is accomplished at the instant when the engine r.p.m. N and the intake air flow rate Q exceed their respective preset levels $N_0$ and $Q_0$, the shocks which might otherwise take place in the conventional engine due to the changes in the fuel supply modes when the ignition switch 21 is manually returned from its starting to "on" position can be eliminated.

Still further, during the operations of the starter 18, i.e., during the engine starting operations covering the whole range of time variations in the engine running parameters, the fuel supply characteristics need not be newly specified but can be determined in accordance with engine conditions prevailing at any particular point in time so that even after a halt in the operation of starter 18, a suitable selection can easily be made between the normal fuel supply mode and the fixed fuel supply mode. Since, furthermore, the hardware and software for effecting the normal fuel supply mode is already available, the improvement in engine startability can be attained without complicating existing circuits and programs.

What is claimed is:

1. In a method for controlling the opening and closing of a fuel injector mounted in the air intake system of an internal combustion engine wherein the flow rate of fuel supplied by the injector is controlled by an electronic control unit in accordance with engine operating conditions, the improvement which comprises the steps of:

detecting during an engine starting period whether the r.p.m. of the engine is greater than a preset level, detecting during said engine starting period whether the flow rate of intake air to said engine is greater than a preset level, operating said control unit such that it fixes the flow rate of fuel supplied by said injector at a predetermined level during said starting period when both the detected engine r.p.m. and flow rate of intake air are below their respective preset levels, and operating said control unit such that it varies the flow rate of fuel supplied by said injector in accordance with engine operating conditions during said starting period when at least one of said detected engine r.p.m. and flow rate of intake air is greater than a respective preset level.

2. The method of claim 1 wherein said control unit varies the fuel supplied to said engine through said injector during engine operation, after starting, in accordance with a predetermined relationship in engine operating parameters and wherein said control unit varies the flow rate of fuel supplied by said injector during said starting period in accordance with said predetermined relationship when at least one of said detected engine r.p.m. and detected flow rate of intake air is greater than its respective preset level.

3. The method of claim 1 further including the step of varying the fixed flow rate of fuel specified by said control unit in accordance with predetermined engine operating conditions existing during said starting period even though said r.p.m. and intake air flow rate are both below their respective preset levels.

4. The method of claim 1 wherein said control unit is operated to vary the flow rate of fuel supplied by said injector only when both said detected engine r.p.m. and flow rate of intake air are greater than respective preset levels.

5. An apparatus for controlling the opening and closing of the fuel passage of a fuel injector mounted in the air intake system of an internal combustion engine comprising first means for detecting the starting period of said engine, second means for indicating when the r.p.m. of said engine exceeds a preset value, third means for indicating when the flow rate of intake air of said engine exceeds a preset level, fourth means for providing signals indicating engine operating parameters, and control means responsive to said first, second, third and fourth means for providing a control signal to said injector which varies the flow rate of fuel supplied by said injector in accordance with said engine operating parameters when at least one of said engine r.p.m. and flow rate of intake air is greater than its respective preset level during said starting period and which fixes the flow rate of fuel supplied by said injector during said starting period when both said engine r.p.m. and flow rate of intake air are below their respective preset levels.

* * * * *